US008308287B2

(12) United States Patent
Ebihara

(10) Patent No.: US 8,308,287 B2
(45) Date of Patent: Nov. 13, 2012

(54) IMAGE RECORDING APPARATUS

(75) Inventor: Toshiyuki Ebihara, Hachioji (JP)

(73) Assignee: Riso Kagaku Corporation, Tokyo (JP)

( * ) Notice: Subject to any disclaimer, the term of this patent is extended or adjusted under 35 U.S.C. 154(b) by 560 days.

(21) Appl. No.: 12/614,559

(22) Filed: Nov. 9, 2009

(65) Prior Publication Data

US 2010/0118098 A1 May 13, 2010

(30) Foreign Application Priority Data

Nov. 11, 2008 (JP) ..... 2008-289131

(51) Int. Cl.
*B41J 2/01* (2006.01)

(52) U.S. Cl. ..... 347/104; 347/101; 347/106; 347/108

(58) Field of Classification Search ..... 347/101, 347/104, 106, 108
See application file for complete search history.

(56) References Cited

U.S. PATENT DOCUMENTS

| | | | | |
|---|---|---|---|---|
| 4,992,805 | A * | 2/1991 | Yoshizawa et al. | 346/134 |
| 6,672,720 | B2 * | 1/2004 | Smith | 347/104 |
| 2006/0071998 | A1 * | 4/2006 | Kruijt | 347/104 |
| 2008/0218578 | A1 * | 9/2008 | Ishihara et al. | 347/104 |

FOREIGN PATENT DOCUMENTS

| | | | |
|---|---|---|---|
| JP | 5-35022 | A | 2/1993 |
| JP | 5-131692 | A | 5/1993 |
| JP | 2003-159841 | A | 6/2003 |

* cited by examiner

*Primary Examiner* — Ryan Lepisto
*Assistant Examiner* — Guy Anderson
(74) *Attorney, Agent, or Firm* — Holtz, Holtz, Goodman & Chick, PC

(57) ABSTRACT

An image recording apparatus comprises a transfer unit having a transfer surface for holding a recording medium and transferring the recording medium held on the transfer surface, a recording head opposed to the transfer unit and recording images on the recording medium transferred by the transfer unit, a suction-force changing unit drawing the recording medium, a support member providing at substantially the same height as the transfer surface of the transfer unit and supporting the suction-force changing unit, and a suction unit drawing the recording medium to a surface of the support member, via the suction-force changing unit.

16 Claims, 15 Drawing Sheets

IMAGE RECORDING APPARATUS

CROSS-REFERENCE TO RELATED APPLICATIONS

This application is based upon and claims the benefit of priority from prior Japanese Patent Application No. 2008-289131, filed Nov. 11, 2008, the entire contents of which are incorporated herein by reference.

BACKGROUND OF THE INVENTION

1. Field of the Invention

The present invention relates to an image recording apparatus in which recording media, such as recording paper sheets, can be reliably supplied by suction to the transfer mechanism.

2. Description of the Related Art

Ink-jet printers have hither to known as image recording apparatuses. Any ink-jet printer has a recording head that has a plurality of nozzles, from which ink droplets are ejected, recording a high-quality image at high speed on a recording medium being transferred by a transfer mechanism. The ink-jet printer has a transfer belt as the transfer mechanism. The transfer belt has a plurality of suction holes. Any ink-jet printer that has a transfer belt comprises a suction unit in most cases. The suction unit draws air through each suction hole of the transfer belt. The suction unit has, for example, a suction fan. The transfer mechanism holds the recording medium on the transfer belt by action, as the suction unit draws air.

While the ink-jet printer is recording (or printing) an image, ink droplets are formed, or ink mist is generated. Therefore, the ink droplets or ink mist may stick to the transfer belt as the ink droplets or ink mist is drawn in the system wherein air is drawn to attract the recording medium to the transfer belt. The ink droplets or ink mist, if any on the transfer belt, may stick to the reverse side of the recording medium, possibly making the recording medium dirty.

An ink-jet printer of the type described above may use the technique of automatically closing those of the suction holes, which are not closed with a recording medium placed on the transfer belt, in order to prevent the medium from becoming dirty with ink droplets or ink mist, to prevent the suction force applied on the recording medium from decreasing due to an in-flow of unnecessary air, and to prevent power consumption of the suction fan.

For example, Jpn. Pat. Appln. KOKAI Publication No. 2003-159841 discloses the technique of automatically opening and closing the valves provided in suction holes. The suction plate has a plurality of suction holes. In each suction hole, a valve is provided, which can open and close in accordance with changes in the amount of air applied by a suction fan. In any suction hole made in that region of the suction plate, which does not contact a paper sheet, air flows in a large amount, closing the valve provided in the suction hole.

Jpn. Pat. Appln. KOKAI Publication No. 5-35022 discloses the technique of opening and closing suction holes with spherical bodies. The drum has a plurality of suction holes. In each suction hole, a movable spherical body is provided. The paper sheet is attracted by suction to any suction hole that is covered with the paper sheet, because the spherical body does not plug the suction hole. In any suction hole that is not covered with the paper sheet, the spherical body plugs the hole, not allowing air to flow through the suction hole.

Jpn. Pat. Appln. KOKAI Publication No. 5-131692 discloses the technique of opening and closing suction holes by using valves. A platen has a plurality of suction holes. Each suction hole has a valve, which has a spring. Each valve automatically opens or closes in accordance with the amount of air flowing through the suction hole. Any suction hole that is not covered with a paper sheet is closed by the valve because air flows in a large amount in the suction hole. Any suction hole that is covered with a paper sheet is opened by the valve because air flows in a small amount in the suction hole.

BRIEF SUMMARY OF THE INVENTION

An image recording apparatus according to a first aspect of the present invention comprises a transfer unit having a transfer surface for holding a recording medium and configured to transfer the recording medium held on the transfer surface; a recording head opposed to the transfer unit and configured to record images on the recording medium transferred by the transfer unit; at least one suction-force changing unit configured to draw the recording medium; a support member provided at substantially the same height as the transfer surface of the transfer unit and supporting the suction-force changing unit; and a suction unit configured to draw the recording medium to a surface of the support member, via the suction-force changing unit, wherein: the suction-force changing unit includes an air passage unit that includes an opening area, and enables air to be drawn from the recording medium side to the suction unit side, and a valve that opens or closes the opening area of the air passage unit in accordance with a pressure difference between the recording medium side and the suction unit side; the valve closes the air passage unit, setting the opening area of the air passage unit to value B ($0<B$), when the pressure in the suction unit side is lower than the pressure at the recording medium side, and opens the air passage unit, setting the opening area of the air passage unit to value A ($B<A$), when the pressure at the recording medium side approaches the pressure in the suction unit side; and the suction-force changing unit draws air from the recording medium side to the suction unit side through the air passage unit having the opening area B, thereby opening the valve that closes the air passage unit because the pressure in the suction unit side is lower than the pressure at the recording medium side, thus lowering the pressure at the recording medium side toward the pressure in the suction unit side.

An image recording apparatus according to a second aspect of the present invention comprises a transfer unit having a transfer surface for holding a recording medium and configured to transfer the recording medium held on the transfer surface; a recording head opposed to the transfer unit and configured to record images on the recording medium transferred by the transfer unit; at least one suction-force changing unit configured to draw the recording medium; a support member provided at substantially the same height as the transfer surface of the transfer unit and supporting the suction-force changing unit; and a suction unit configured to draw the recording medium to a surface of the support member, via the suction-force changing unit, wherein: the suction-force changing unit includes a plurality of air passage units which are provided between the recording medium side and the suction unit side and which serve to draw air toward the suction unit, and a valve that opens or closes only some of the air passage units; the valve closes some of the air passage units when the pressure in the suction unit side becomes lower than the pressure at the recording medium side; and a pressure difference between the recording medium side and the suction unit side decreases as air is drawn from the recording medium side toward the suction unit side, and the valve opens some of the air passage units, when air is drawn from the recording medium side toward the suction unit side through the other air passage units not closed by the suction-force changing unit, immediately after the suction unit is covered with the recording medium transferred.

An image recording apparatus according to a third aspect of the present invention comprises a transfer unit having a transfer surface for holding a recording medium and configured to transfer the recording medium held on the transfer surface; a recording head opposed to the transfer unit and configured to record images on the recording medium transferred by the transfer unit; at least one suction-force changing unit configured to draw the recording medium; a support member provided at substantially the same height as the transfer surface of the transfer unit and supporting the suction-force changing unit; a suction unit configured to draw the recording medium to a surface of the support member, via the suction-force changing unit; a first air passage unit provided in the suction-force changing unit and enabling air to flow between the recording medium side and the suction unit side; a valve configured to open and close the first air passage unit by virtue of a pressure difference between the recording medium side and the suction unit side; a second air passage unit provided in the suction-force changing unit and configured to draw air from the recording medium side toward the suction unit side and thereby decrease the pressure difference between the recording medium side and the suction unit side in order to open the first air passage unit, when the recording medium covers the suction unit in a state where the valve closes the first air passage unit.

An image recording apparatus according to a fourth aspect of the present invention comprises a transfer unit having a transfer surface for holding a recording medium and configured to transfer the recording medium held on the transfer surface; a recording head opposed to the transfer unit and configured to record images on the recording medium transferred by the transfer unit; at least one suction-force changing unit configured to draw the recording medium; a support member provided at substantially the same height as the transfer surface of the transfer unit and supporting the suction-force changing unit; a suction unit configured to draw the recording medium to a surface of the support member, via the suction-force changing unit; a first air passage unit provided in the suction-force changing unit and enabling air to flow between the recording medium side and the suction unit side; a valve configured to open and close the first air passage unit by virtue of a pressure difference between the recording medium and the suction unit; a second air passage unit provided in the suction-force changing unit and configured to draw air from the recording medium side to the suction unit side and thereby decrease the pressure difference between the recording medium side and the suction unit side in order to open the valve that closes the first air passage unit, when the recording medium covers the suction unit.

DETAILED DESCRIPTION OF THE INVENTION

A first embodiment of this invention will be described with reference to the accompanying drawings.

Figure 1:
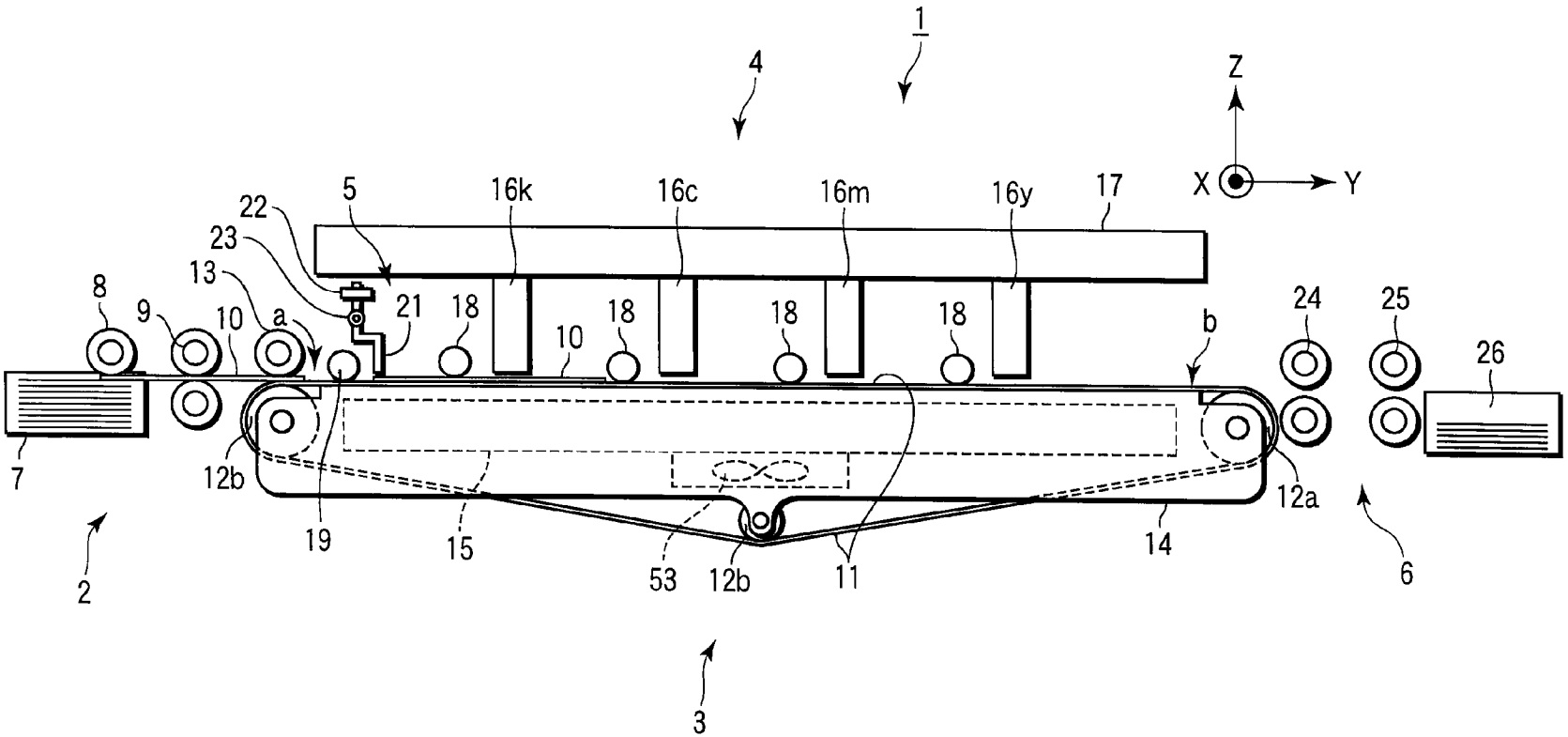
FIG. 1 is a side view showing the major components of a first embodiment of an image recording apparatus according to the present invention.

FIG. 1 shows the major components of an image recording apparatus 1 according to the invention. The recording medium is, for example, a paper sheet 10. The direction in which the paper sheet 10 is transferred is Y-axis direction. In the side of the paper sheet 10, on which an image will be formed, the direction orthogonal to the Y-axis direction is X axis. The direction orthogonal to X axis and Y axis is Z axis.

The image recording apparatus 1 comprises a sheet feeding unit 2, a platen unit 3, an image recording unit 4, a medium-floating detecting unit 5, and a recording-medium ejecting unit 6.

The sheet feeding unit 2 comprises a sheet tray 7, a pickup roller 8, and a pair of registration rollers 9. The sheet tray 7 can hold sheets 10 that are used as recording media. The pickup roller 8 is a sheet extracting mechanism. The pickup roller 8 is supported by the main frame of the apparatus 1 and can rotate. The pickup roller 8 extracts sheets 10, one by one, from the sheet tray 7.

The registration rollers 9 have two rollers. The registration rollers 9 are supported by the main frame of the apparatus 1 and can rotate. The registration rollers 9 correct the position of any paper sheet 10 extracted by the pickup roller 8 if the paper sheet 10 is in, for example, a slanting position. That is, the rollers 9 align the paper sheet 10, coming in a slanting position, with the transfer direction (Y-axis direction). The registration rollers 9 feed the paper sheet 10 to the platen unit 3 at the time the image recording unit 4 forms an image.

The platen unit 3 transfers the sheet 10 fed from the sheet feeding unit 2. The platen unit 3 has a transfer belt 11, a drive roller 12*a*, a plurality of driven rollers 12*b*, an upper driven roller 13, and a platen frame 14. The platen frame 14 has a platen suction unit 15.

The transfer belt 11 is a belt shaped endless. The transfer belt 11 has a plurality of small through holes, which are made in the entire surface of the belt 11. The transfer belt 11 is wrapped around, between a drive roller 12*a* and the driven rollers 12*b*.

The transfer belt 11, the drive rollers 12*a*, and the driven rollers 12*b* constitute a belt conveyor. The belt conveyor transfers the paper sheet 10 in the Y-axis direction.

At the upstream of the platen unit 3, the upper driven roller 13 is provided. The upper driven roller 13 prevents the paper sheet 10 from floating. The upper driven roller 13 is arranged at the end of the transfer belt 11, which is upstream with respect to the direction in which the paper sheet 10 is transferred.

The platen suction unit 15 has a fan 53. The fan 53 generates an air stream that flows from the upper part of the platen unit 3 toward the lower part thereof. By virtue of the air stream, the paper sheet 10 is drawn to the platen unit 3.

The image recording unit 4 ejects ink to the paper sheet 10. The image recording unit 4 is arranged above the transfer belt 11. The image recording unit 4 has a recording head 16 and a carriage 17.

The recording head 16 comprises ink-jet recording heads 16*k*, 16*c*, 16*m* and 16*y*, which are associated with, for example, black (K), cyan (C), magenta (M) and yellow (Y), respectively. The ink-jet recording heads 16*k*, 16*c*, 16*m* and 16*y* eject black (K) ink, cyan (C) ink, magenta (M) ink and yellow (Y) ink, respectively. The ink-jet recording heads 16*k*, 16*c*, 16*m* and 16*y* are arranged, at almost regular intervals, in the direction (Y-axis direction) in which the paper sheet 10 is transferred.

The ink-jet recording heads 16*k*, 16*c*, 16*m* and 16*y* have a width (in X-axis direction) equal to or greater than the maximum width the paper sheet 10 used in this apparatus 1 may have. If the largest paper sheet on which the apparatus 1 can record images is, for example, the A3-size sheet, the recording heads 16*k*, 16*c*, 16*m* and 16*y* have a width (in X-axis direction) equal to or larger than the width of the A3-size sheet.

At upstream of the recording heads 16*k*, 16*c*, 16*m* and 16*y*, with respect to the sheet transfer direction, second sheet guides 18 are arranged. Each of the second sheet guides 18 is a roller. Each second sheet guide 18 can rotate, supported at both ends by the main frame of the apparatus.

Each second sheet guide 18 prevents the paper sheet 10 from floating, and guides the paper sheet 10, making the same travel below the recording heads 16*k*, 16*c*, 16*m* and 16*y*.

The medium-floating detecting unit 5 has a first sheet guide 19, a sheet-floating detecting plate 21, and a sensor 22. Only one first sheet guide 19 is provided. The first sheet guide 19 is arranged, more downstream than all recording heads 16*k*, 16*c*, 16*m* and 16*y*, with respect to the sheet transfer direction. The first sheet guide 19 is a roller that suppresses the floating of the paper sheet 10. The first sheet guide 19 can rotate, supported at both ends by the main frame of the apparatus 1.

The sheet-floating detecting plate 21 is located more downstream than the first sheet guide 19, with respect to the transfer direction of the paper sheet. The sheet-floating detecting plate 21 detects that the paper sheet 10 being transferred has reached a level higher than a prescribed level, in order to prevent the paper sheet 10 from contacting the recording heads 16*k*, 16*c*, 16*m* and 16*y*. The sheet-floating detecting plate 21 is pivotally supported by a shat 23. The sensor 22 is arranged in the vicinity of the upper edge of the sheet-floating detecting plate 21. When the paper sheet 10 abuts on the sheet-floating detecting plate 21, the sensor 22 detects the motion of the sheet-floating detecting plate 21.

The sheet-floating detecting plate 21 is arranged at such a position that a predetermined gap is provided between its lower end and the transfer surface of the transfer belt 11.

The recording-medium ejecting unit 6 is arranged more downstream, in the sheet transfer direction, than the position where the platen unit 3 and the image recording unit 4 are arranged. The recording-medium ejecting unit 6 ejects the paper sheet 10 having an image printed by the image recording unit 4, out of the main body of the apparatus 1. The recording-medium ejecting unit 6 has a pair of ejection-transfer rollers 24, a pair of ejection-port rollers 25, and an ejection tray 26.

The ejection-transfer rollers 24 transfer the paper sheet 10 transferred from the platen unit 3, toward the ejection-port rollers 25. The ejection-port rollers 25 eject the paper sheet 10 transferred from the ejection-transfer rollers 24, onto the ejection tray 26.

Figure 2:
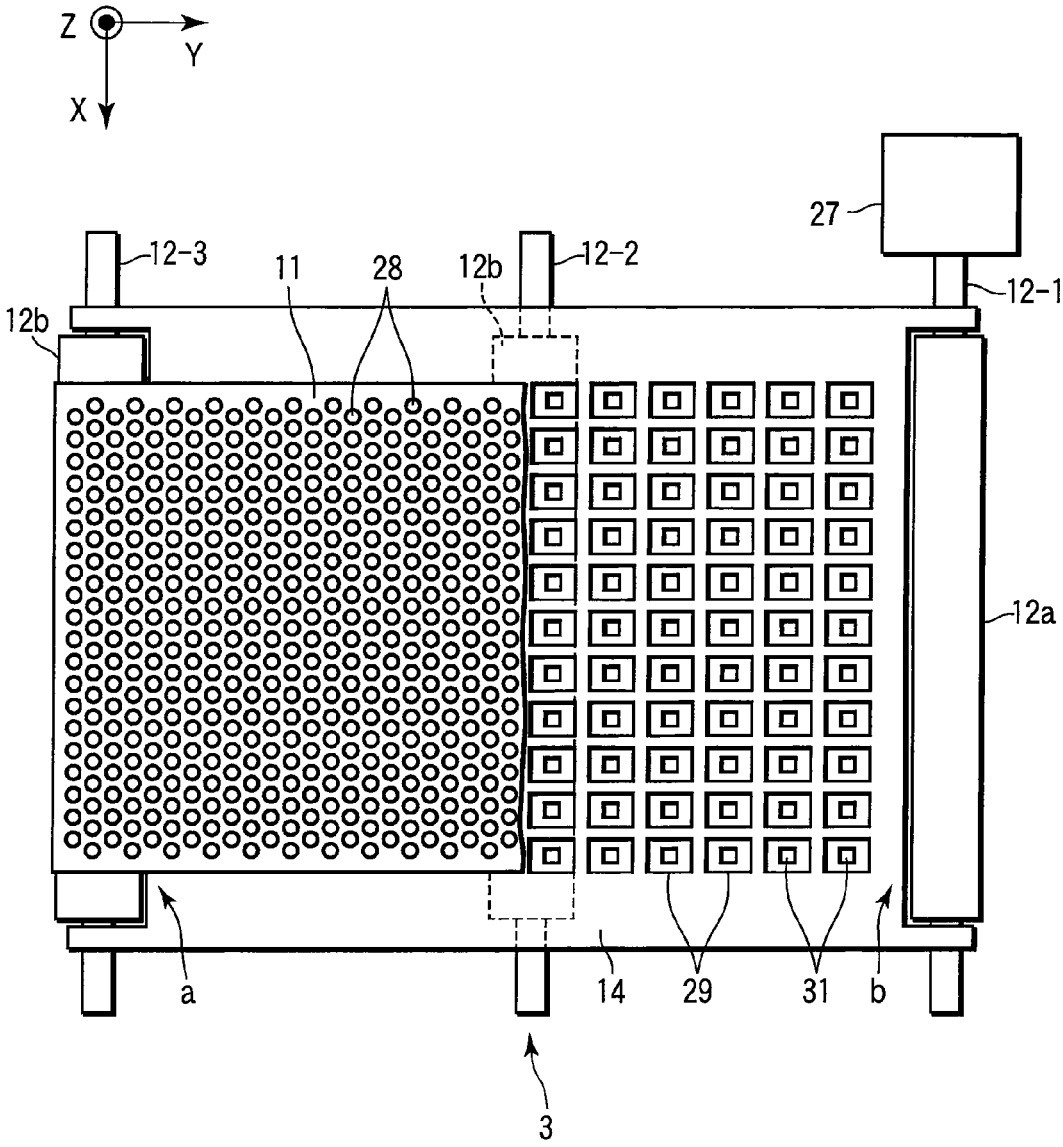
FIG. 2 is a top view showing the platen of the apparatus.

FIG. 2 is a top view showing the platen unit 3. For the purpose of illustrating the configuration of the platen unit 3, the right half of the transfer belt 11 is shown in section taken along the Y-axis direction.

A roller drive motor 27 is connected to the shaft 12-1 of the drive rollers 12*a*.

A plurality of suction holes 28 are made in the entire surface of the transfer belt 11, forming a uniform pattern. Below the transfer belt 11, the platen frame 14 is provided. The platen frame 14 supports the transfer belt 11 in a horizontal position. The platen frame 14 supports the drive rollers 12*a* and the driven rollers 12*b*, allowing them to rotate, and further holds the platen suction unit 15 shown in FIG. 1.

The platen suction unit 15 comprises a fan 53 configured to attract the paper sheet 10, by suction, to the transfer belt 11.

The platen frame 14 has an XY surface as a belt transfer surface, which extends in the X-axis direction and Y-axis direction. As shown in FIG. 2, a plurality of depressions 29 are made in the XY surface of the platen frame 14. Each depression 29 has a suction hole 31 made almost at the center.

Figure 3:
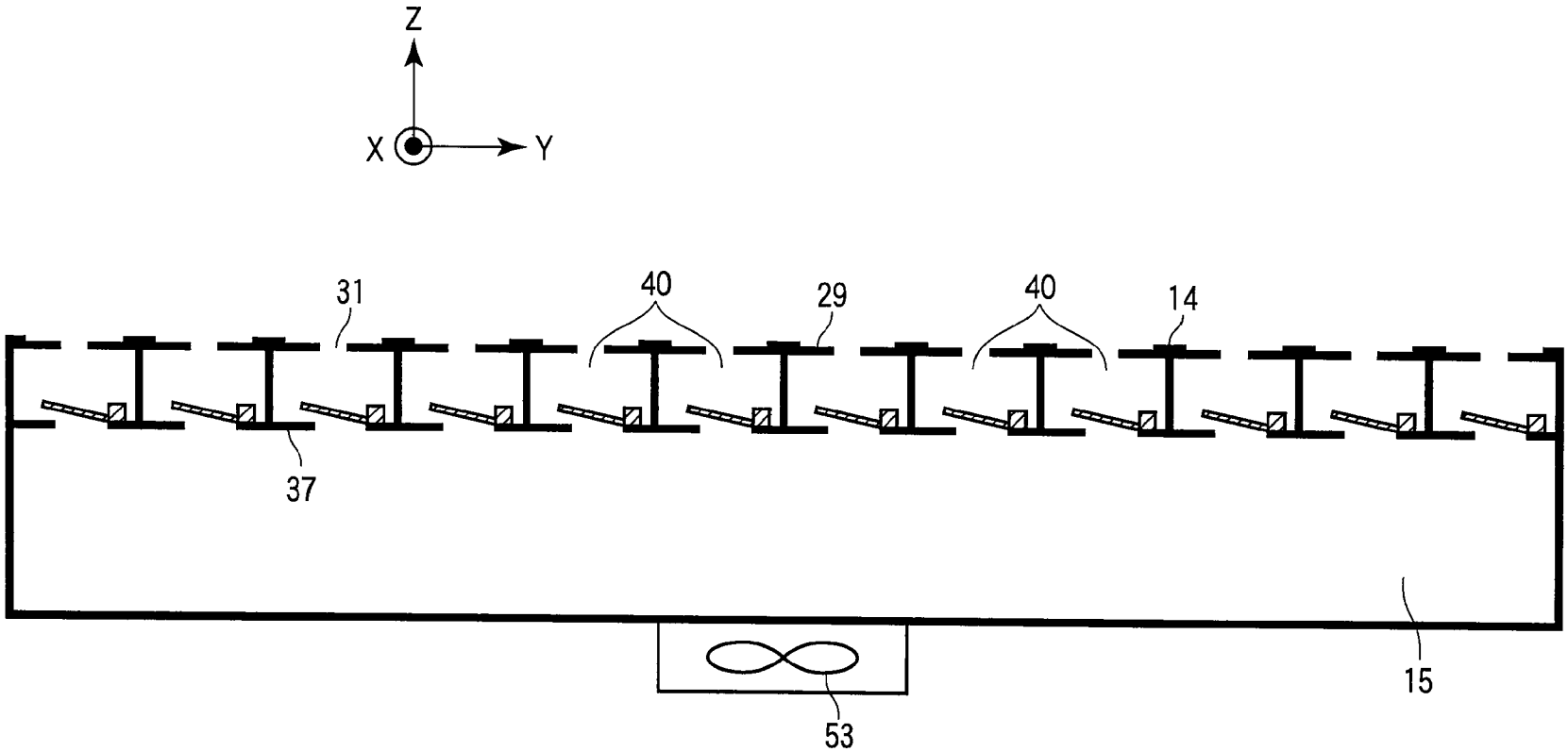
FIG. 3 is a sectional view showing the platen frame of the apparatus.
Figure 4:
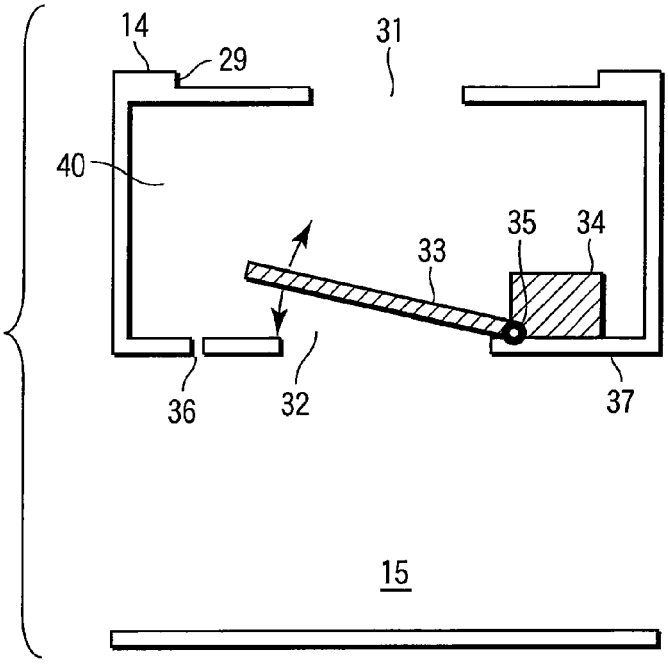
FIG. 4 is a sectional view showing one of the small chambers provided in the apparatus.

FIG. 3 is a sectional view of the platen frame 14. FIG. 4 is a sectional view showing the small chamber 40 of each unit.

The upper surface (i.e., belt transfer surface) of the platen frame 14 has the depressions 29. Each depression 29 has a suction port 31 in the bottom. Below the depression 29, small chambers 40 are provided, each in association with one suction hole 31. The suction hole 31 connects the depression 28 and the small chamber 40.

Figure 5:
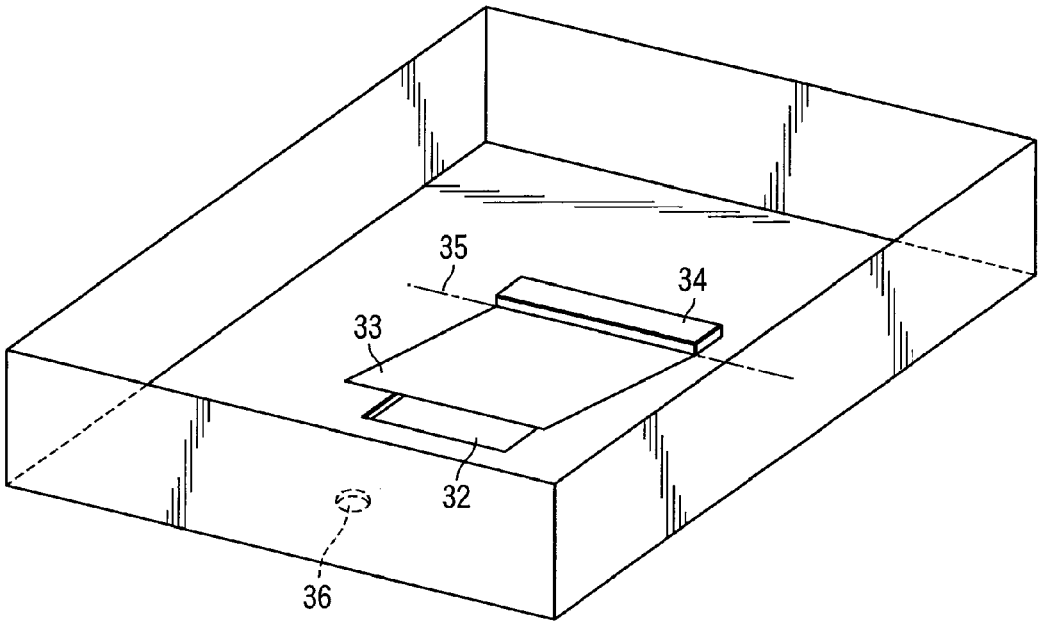
FIG. 5 is a perspective view showing one of the small chambers provided in the apparatus.

FIG. 5 is a perspective view showing one of the small chambers 40. In the bottom of the small chamber 40, a large suction hole 32 and a small suction hole 36 are made, the former having a larger opening area than the latter. The large suction hole 32 and the small suction hole 36 communicate with the interior of the small chamber 40 and the platen suction unit 15, respectively. The large suction hole 32 and the small suction hole 36 have a rectangular shape in this embodiment. They can be circular, nevertheless. Further, the large suction hole 32 and the small suction hole 36 can be made at any other positions, so far as they are made in the bottom of the small chamber 40.

A valve 33 is made in the bottom of each small chamber 40. The valve 33 can rotate around an axle 35. The valve 33 can open and close the large suction hole 32.

The valve 33 is formed integrally with a weight 34 that is used as a balancer. The weight 34 is a weight that facilitates the opening and closing of the valve 33. When no negative pressure is generated by the platen suction unit 15, the valve 33 rotates in, for example, the clockwise direction (FIG. 4), around the axle 35 by virtue of the weight of the weight 34, thereby opening the suction hole 32. When a negative pressure is generated by the platen suction unit 15, the valve 33 is drawn to the suction hole 32 side, because of the pressure difference between the small chamber 40 and the platen suction unit 15. As a result, the valve 33 rotates in the counterclockwise direction (FIG. 4) around the axle 35, closing the suction hole 32. To open the valve 33, a spring may be used in place of the weight 34.

The small suction hole 36 has an opening area far smaller than that of the large suction hole 32. The small suction hole 36 is made in the bottom of the small chamber 40, at the position where it is not closed by the valve 33. Thus, the small suction hole 36 communicates with the small chamber 40 and platen suction unit 15, at all times.

The large suction hole 32 and the small suction hole 36 constitute an opening part, which is made in the bottom of the small chamber 40. Therefore, as the large suction hole 32 is opened or closed, the opening area of the opening part provided in the bottom of the small chamber 40 varies. That is, the bottom of the small chamber 40 has opening area A when the valve 33 opens the large suction hole 32, opening area B when the valve 33 closes the large suction hole 32. Hence, the opening area can have three values 0, B and A, which have the relation of $0<B<A$. That is, the suction hole 32 and the suction hole 36 have such diameters as define the relation of $0<B<A$.

In other words, the opening part has a large suction hole 32 and a small suction hole 36. The valve 33 is provided to open and close the large suction hole 32. While the valve 33 keeps opening the large suction hole 32, the total opening area is A, i.e., the sum of the opening areas of the suction hole 32 and suction hole 36 is A. While the valve 33 is closing the large suction hole 32, the total opening area is B, i.e., the sum of the opening area of the small suction hole 36 only. The size of the valve 33, the opening areas of the suction holes 32 and 36 are have been determined to achieve the above-mentioned relation of $0<B<A$.

Figure 6:
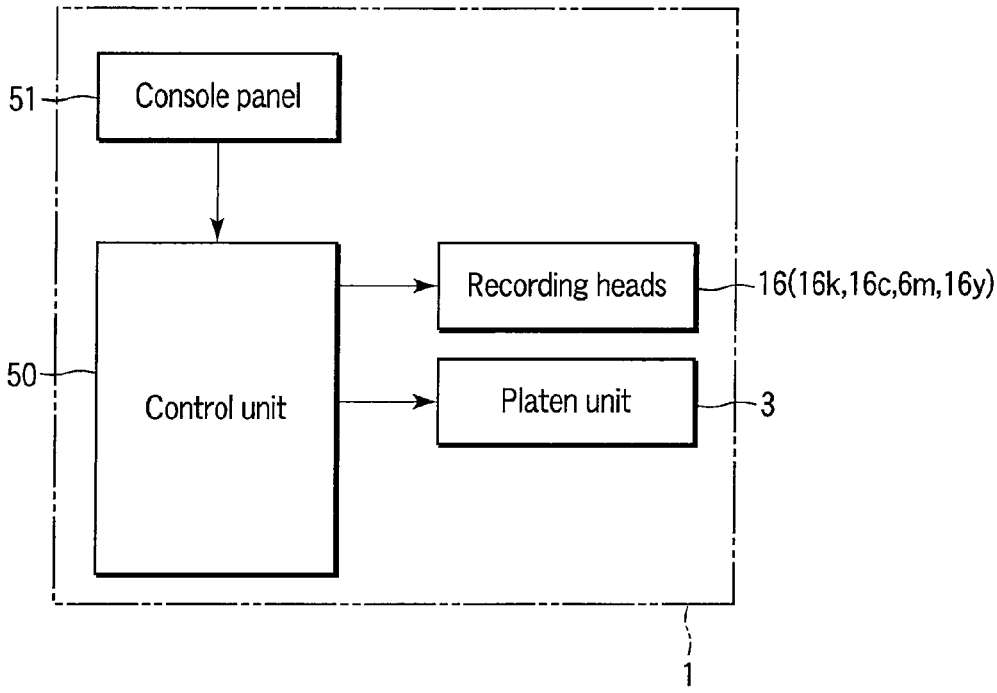
FIG. 6 is a block diagram of the control system provided in the apparatus.

FIG. 6 is a block diagram showing the configuration of the control system provided in the apparatus 1. The system has a control unit 50. The control unit 50 comprises, for example, a CPU, a RAM and a ROM. The control unit 50 controls the sequence of image recording in the apparatus 1. To the control unit 50, a console panel 51, the recording heads 16*k*, 16*c*, 16*m* and 16*y*, and the platen unit 3 are connected. The control unit 50 controls the recording heads 16*k*, 16*c*, 16*m* and 16*y* and the platen unit 3, as the sequence of image recording proceeds. The console panel 51 has various buttons. The buttons may be operated by the user to designate the material, number, printing mode and the like about the paper sheets 10 used to record images.

The control unit 50 is connected via a network to a host apparatus. The host apparatus supplies commands to the control unit 50. The commands designate the number, printing mode and the like about the paper sheets 10.

The image recording that the apparatus 1 configured as described above performs will be explained in brief.

First, the power switch is turned on. Next, the console panel 51 or the host apparatus is operated, inputting the data representing the material, number and the like of paper sheets 10 to use in image recording. The control unit 50 starts a printing process, recording characters, images, and the like. That is, the control unit 50 controls the recording heads 16 and the platen unit 3 as the sequence of image recording proceeds.

The pickup roller 8 extracts the paper sheets 10, one by one, from the sheet tray 7, first extracting the uppermost paper sheet. It extracts one sheet 10 every time it rotates once. The pickup roller 8 feeds each paper sheet 10 extracted from the sheet tray 7, to the registration rollers 9 that is arranged in pair. The registration rollers 9 temporarily stop rotating, and corrects the position of the paper sheet 10 if the paper sheet 10 assumes, for example, a slanting position with respect to the main scanning direction (i.e., X direction). The registration rollers 9 wait until the time the paper sheet 10 should be transferred forwards. When this time comes, the registration rollers 9 starts transferring the paper sheet 10 toward the platen unit 3.

When the paper sheet 10 fed to the platen unit 3 reaches that end of the platen unit 3, which is upstream with respect to the sheet transfer direction, the paper sheet 10 is guided by the upper driven roller 13 to the first sheet guide 19. The paper sheet 10 travels below the first sheet guide 19 and sheet-floating detecting plate 21, while being prevented from floating by the first sheet guide 19, and is then placed onto the transfer belt 11 and transferred forwards. The paper sheet 10 reaches the second sheet guide 18 located immediately before the first recording head 16*k*. Next, the paper sheet 10 travels below the recording heads 16*k*, 16*c*, 16*m* and 16*y*, one after another. While the paper sheet 10 is so traveling, characters and an image are recorded on the paper sheet 10. The paper sheet 10 is then transferred to the recording-medium ejecting unit 6.

How each valve 33 operates during the image recording process described above will be explained with reference to FIG. 7A to FIG. 7C.

The paper sheet 10 laid on the transfer belt 11 travels over the depressions 29 made in the upper surface of the platen frame 14.

Figure 7A:
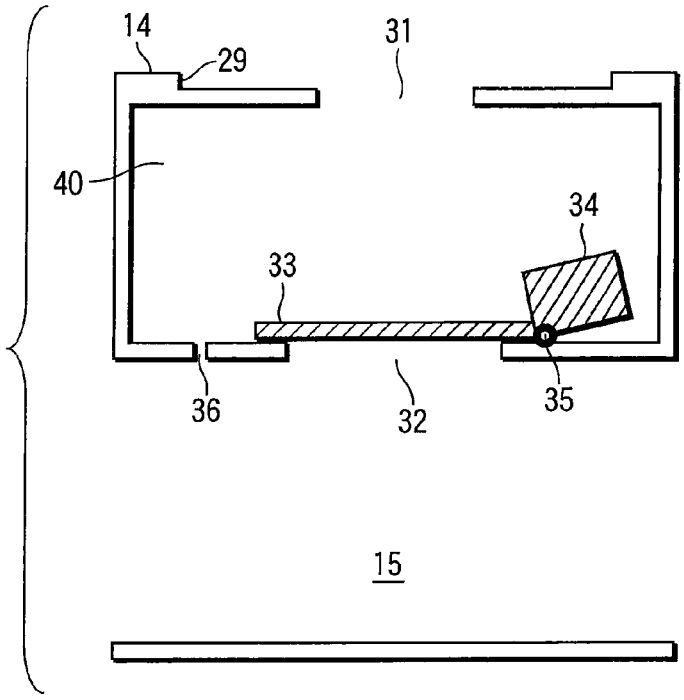
FIG. 7A is a diagram showing the state a valve assumes in the apparatus while no paper sheets are being transferred over depressions.

FIG. 7A shows the state that the paper sheet 10 does not reach a position over a depression 29 yet. At this time, the suction hole 31 made in the depression 29 is open. An air stream flows from the small chamber 40 (a recording medium side) toward the platen suction unit 15 side(a suction unit side). This is due to the difference between the pressure in the small chamber 40 and the pressure in the platen suction unit 15. The air stream rotates the valve 33 around the axle 35 in the counterclockwise direction. Hence, the valve 33 closes the large suction hole 32.

At this time, the small suction hole 36 is not closed. Nonetheless, air flows in a small amount through the small suction hole 36 into the platen suction unit 15 side. Furthermore, the small chamber 40 communicates with the atmosphere through the large suction hole 31. Therefore, the difference of the pressure in the small chamber 40 (the recording medium side) and the pressure in the platen suction unit 15 (the suction unit side) changes little. The valve 33 therefore keeps closing the suction hole 32.

Figure 7B:
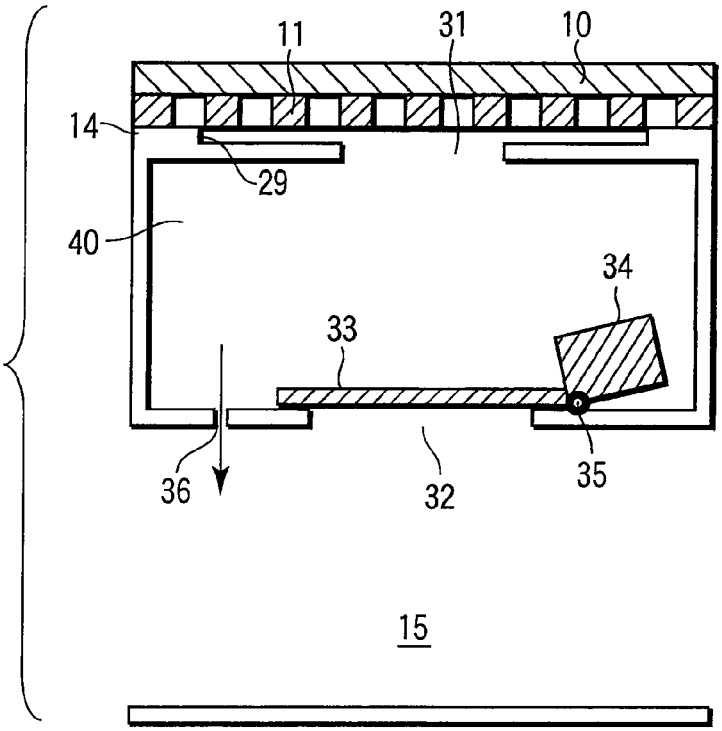
FIG. 7B is a diagram showing the state the valve assumes in the apparatus when a paper sheet is transferred, covering the depressions.

FIG. 7B shows the state that immediately after the paper sheet 10 has been transferred, covering the depressions 29. Each suction hole 31 is closed by the paper sheet 10, whereby the small chamber 40 isolated from the atmosphere. By contrast, the small suction hole 36 remains open, and an air stream flows into the platen suction unit 15 side through the small suction hole 36. Consequently, the pressure in the small chamber 40 falls fast.

Figure 7C:
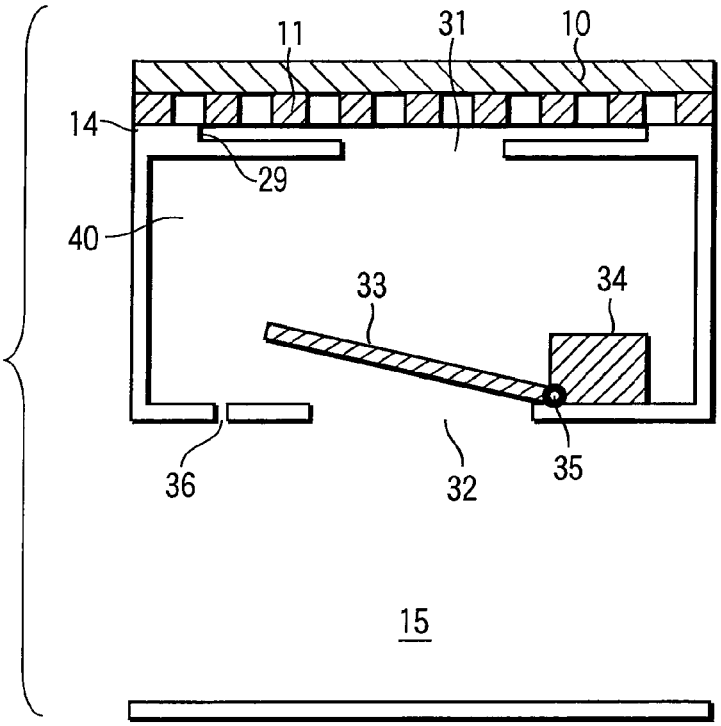
FIG. 7C is a diagram showing the depression covered with a paper sheet in the apparatus.

As a result, the difference between the pressure in the small chamber 40 and the pressure in the platen suction unit 15 side gradually decrease. The moment deriving from the weight of the weight 34 becomes larger than the force (moment) that pushes down the valve 33 to close the large suction hole 32. The valve 33 therefore rotates in the clockwise direction, opening the large suction hole 32 as shown in FIG. 7C.

When the large suction hole 32 is opened, the pressure in the small chamber 40 becomes equal to the pressure in the platen unit 15 side. As a result, a difference is made between the pressure outside the platen unit 14 and the pressure in the small chamber 40. This pressure difference draws the paper sheet 10 to the transfer belt 11 on the upper side of the platen frame 14.

In the first embodiment described above, while no paper sheets 10 remain on the platen frame 14, each valve 33 automatically closes the associated large suction hold 32, preventing a flow of unnecessary air. If the paper sheet 10 covers the suction hole 31 made in the depression 29, air will flow from the small chamber 40 through the small suction hole 36, fast lowering the pressure in the small chamber 40. Therefore, the valve 33 rotates in the clockwise direction, opening the large suction hole 32 as shown in FIG. 7C. The paper sheet 10 is thereby drawn to the upper surface of the platen frame 14, more precisely onto the transfer belt 11.

In the present embodiment, the small suction hole 36 made in the bottom of each small chamber 40 serves to open and close the valve 33. No dedicated mechanisms are required to open and close the valve 33. This can reduce the manufacturing cost.

A second embodiment of this invention will be described with reference to the accompanying drawings. Note that the image recording apparatus 1 according to the second embodiment is identical in overall configuration to the apparatus shown in FIG. 1 and FIG. 2.

Figure 8:
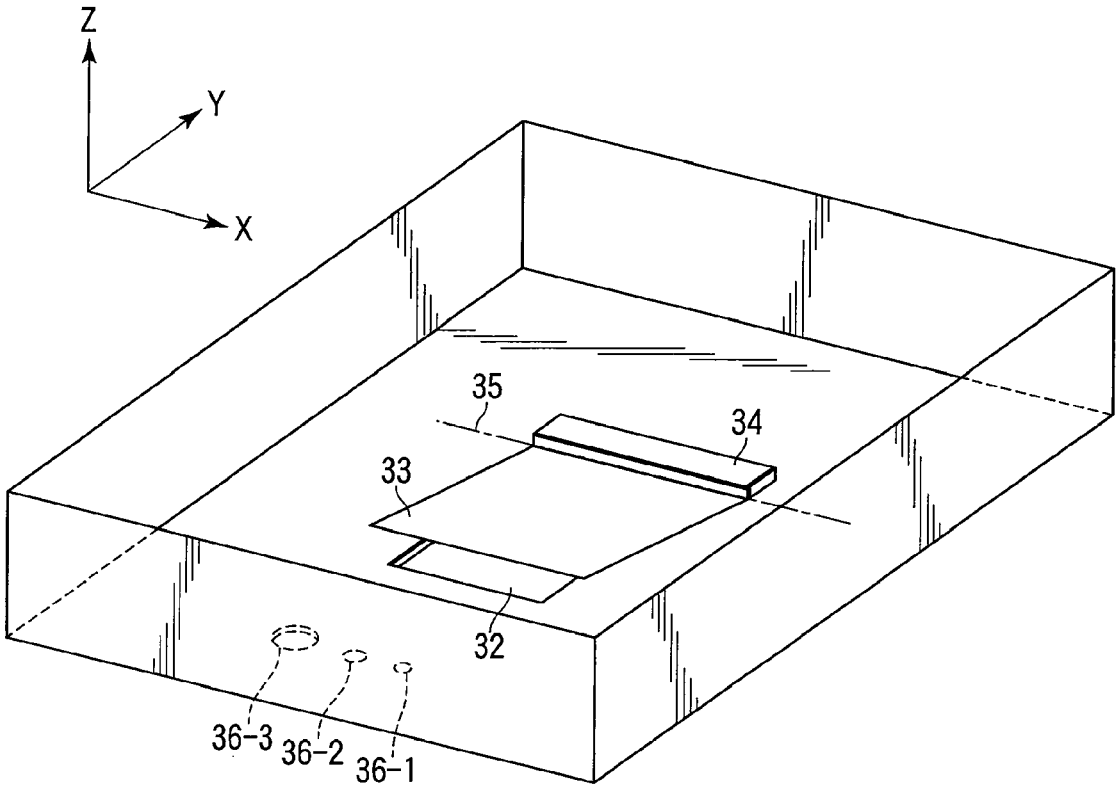
FIG. 8 is a perspective view showing one of the small chambers provided in a second embodiment of an image recording apparatus according to this invention.

FIG. 8 is a perspective view showing one of the small chambers provided in the image recording apparatus 1. In this apparatus 1, the opening size of the small suction holes 36 varies. The bottom of each small chamber 40 has, for example, three small suction holes 36-1, 36-2 and 36-3, not one small suction hole 36 as in the first embodiment. The small suction holes 36-1, 36-2 and 36-3 have different opening areas. More specifically, the suction hole 36-1 is the smallest, the suction hole 36-2 is the next smallest, and the suction hole 36-3 is the largest of the three. The small suction holes 36-1, 36-2 and 36-3 are arranged in, for example, the X-axis direction that is orthogonal to the sheet transfer direction.

Figure 9:
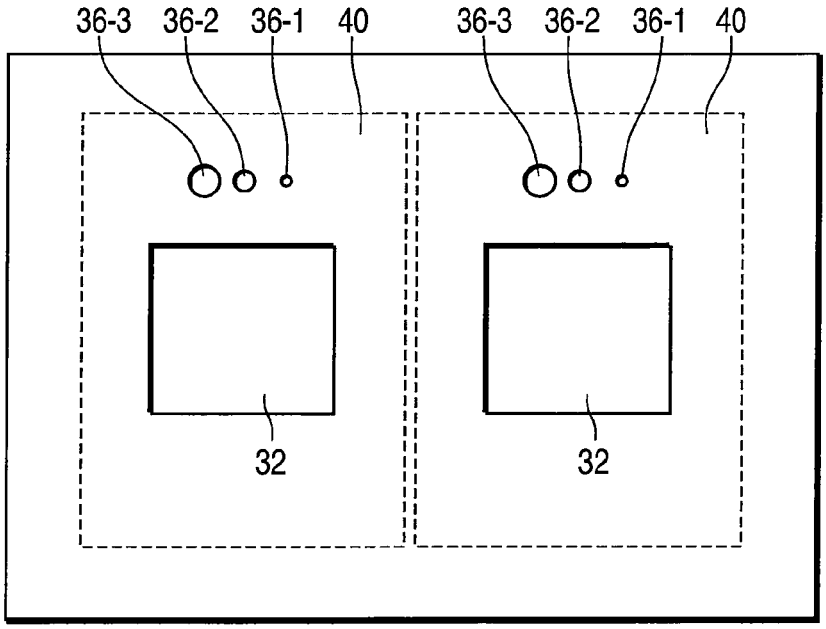
FIG. 9 is a diagram showing two small chambers provided in the apparatus.

FIG. 9 is a diagram showing, for example, two of the small chambers 40 as viewed from above. The small suction holes 36-1, 36-2 and 36-3 of each small chamber 40 are arranged on a line extending in the X-axis direction. Since more than two small chambers 40 are arranged in the X-axis direction, the small suction holes 36-1, 36-2 and 36-3 of each small chamber 40 are arranged on a line extending in the X-axis direction.

Figure 10:
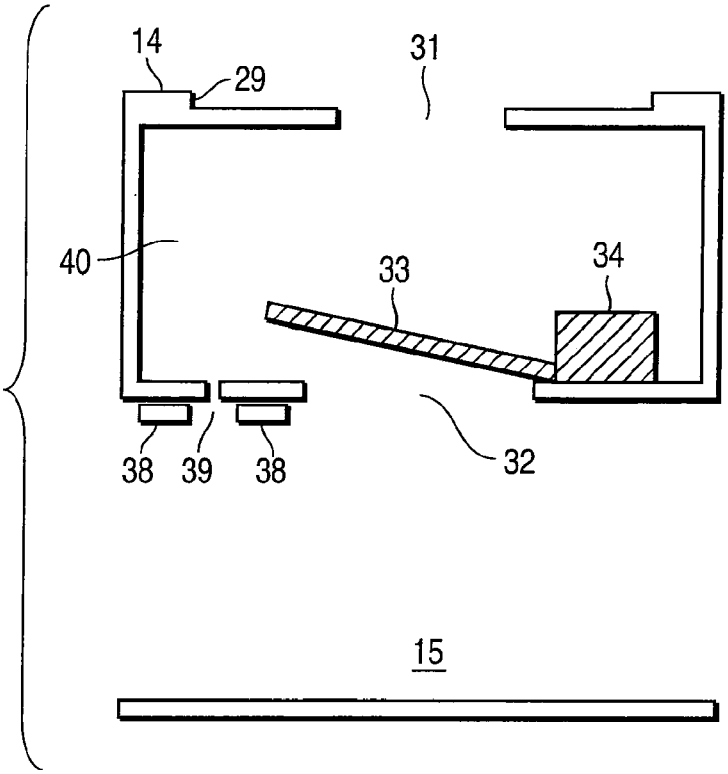
FIG. 10 is a sectional view showing one of the small chambers provided in the apparatus.
Figure 11:
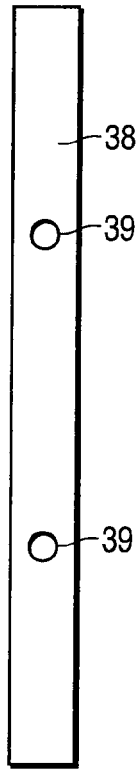
FIG. 11 is a diagram showing the configuration of a suction-hole selecting member used in the apparatus.

FIG. 10 is a sectional view that shows one of the small chambers 40. On the bottom of the small chamber 40, a suction-hole selecting member 38 is provided. The suction-hole selecting member 38 contacts the bottom of the small chamber 40 and can slide in the X-axis direction. The suction-hole selecting member 38 can slide over all small suction holes 36-1, 36-2 and 36-3 of the small chamber 40. The suction-hole selecting member 38 is shaped like, for example, a plate as is illustrated in FIG. 11.

The suction-hole selecting member 38 has selection holes 39. The selection holes 39 are positioned not to cover one of the small suction holes 36-1, 36-2 and 36-3, and to cover the remaining two small suction holes. In other words, as the suction-hole selecting member 38 slides, each selection hole 39 comes into alignment with one of the small suction holes 36-1, 36-2 and 36-3, thereby selecting one of the small suction holes 36-1, 36-2 and 36-3, and closing the other two small section holes.

The intervals at which the selection holes 39 are arranged is equal to the distance between the small suction holes 36-1 of the small chambers 40, to the distance between the small suction holes 36-2 thereof, and to the distance between the small suction holes 36-3 thereof. The suction-hole selecting member 38 has two selection holes 39, which are associated with the small chambers 40 shown in FIG. 9. In the actual situation, however, the suction-hole selecting member 38 has as many selection holes 39 as the small chambers 40 arranged in the X-axis direction as illustrated in FIG. 2.

Figure 12:
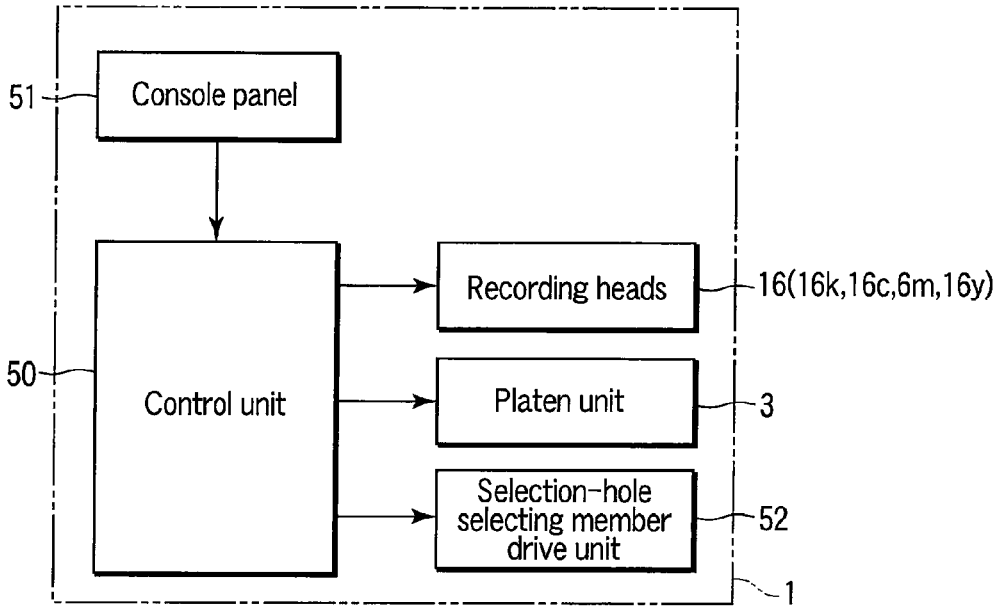
FIG. 12 is a block diagram of the controls system provided in the apparatus.

FIG. 12 is a block diagram of the controls system provided in the apparatus 1 according to the second embodiment. The system has a control unit 50. To the control unit 50, a selection-hole selecting member drive unit 52 is connected. The selection-hole selecting member drive unit 52 slides the suction-hole selecting member 38 in the X-axis direction.

The control unit 50 drives and controls the selection-hole selecting member drive unit 52, which slides the suction-hole selecting member 38 in the X-axis direction. The control unit 50 slides the suction-hole selecting member 38 in the X-axis direction, in accordance with the speed with which the platen unit 3 transfers the paper sheet 10. One of the small suction holes 36-1, 36-2 and 36-3 is thereby selected. The opening area defined by the large suction hole 32 and one of the small suction holes 36-1, 36-2 and 36-3 is thereby changed.

To be more specific, if the platen unit 3 transfers the paper sheet 10 at high speed, the control unit 50 slides the member 38 to increase the opening area. That is, the control unit 50 selects, for example, the small suction hole 36-3. Conversely, the platen unit 3 may transfer the paper sheet 10 at low speed. In this case, the control unit 50 slides the member 38 to decrease the opening area. Thus, the control unit 50 selects, for example, the small suction hole 36-1.

Figure 13A:
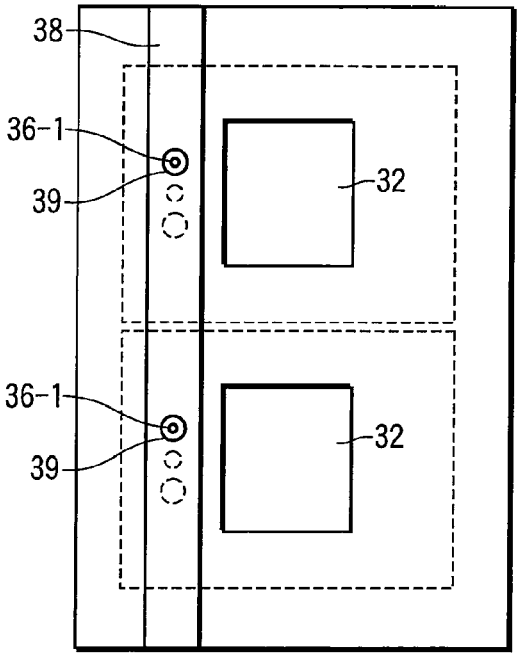
FIG. 13A is a diagram of the suction-hole selecting member, showing the holes thereof aligned with those suction holes, which have the smallest open areas.

FIG. 13A shows the suction-hole selecting member 38 so positioned that the selection holes 39 are aligned with the small suction holes 36-1 of the small chambers 40. Therefore, only each small suction hole 36-1, which has the smallest opening area of the three suction holes 36-1 to 36-3, is opened, and the two other suction holes 36-2 and 36-3 are closed.

Figure 13B:
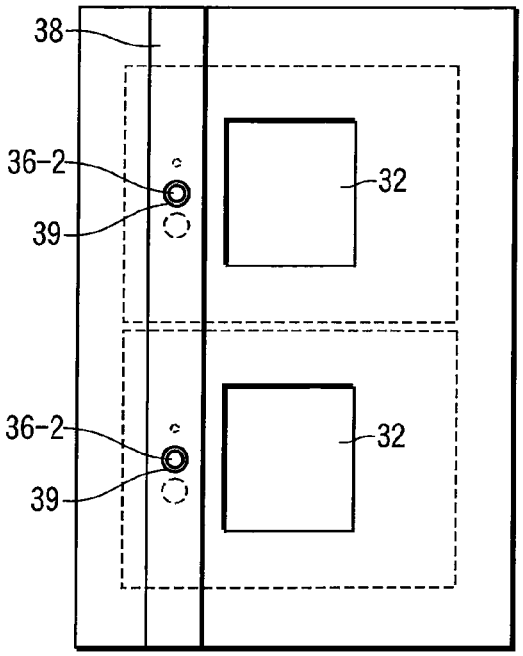
FIG. 13B is a diagram of the suction-hole selecting member, showing the holes thereof aligned with those suction holes, which have the second smallest open areas.

FIG. 13B shows the suction-hole selecting member 38 so positioned that the selection holes 39 are aligned with the suction holes 36-2 of the small chambers 40. Thus, only each small suction hole 36-2, which has the second smallest opening area, is opened, and the two other suction holes 36-1 and 36-3 are closed.

Figure 13C:
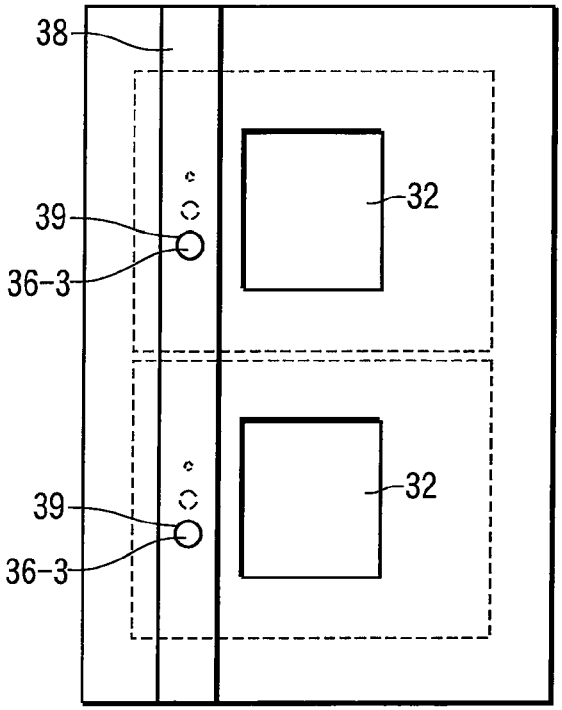
FIG. 13C is a diagram of the suction-hole selecting member, showing the holes thereof aligned with those suction holes, which have the largest open areas.

FIG. 13C shows the suction-hole selecting member 38 so positioned that the selection holes 39 are aligned with the suction holes 36-3 of the small chambers 40. In this case, only each small suction hole 36-3, which has the largest smallest opening area, is opened, and the two other suction holes 36-1 and 36-2 are closed.

In the second embodiment, three suction holes 36-1 to 36-3 having different opening areas are made in the bottom of each small chamber 40. The suction-hole selecting member 38 that has selection holes 39 is provided to slide on the bottoms of the small chambers 40. The control unit 50 controls the sliding of the suction-hole selecting member 38, in accordance with the speed with which the paper sheet 10 is transferred by the platen unit 3. The suction-hole selecting member 38 therefore selects one of the small suction holes 36-1 to 36-3. The opening area defined by the large suction hole 32 and one of the small suction holes 36-1 to 36-3 is thereby changed.

The user may change the recording mode of the image recording apparatus 1, changing the transfer speed of the paper sheet 10. In this case, the control unit 50 controls the sliding of the suction-hole selecting member 38. One of the small suction holes 36-1 to 36-3 is thereby selected.

The case where the largest of the small suction holes 36-1 to 36-3 is selected will be explained first. As mentioned above, FIG. 7B shows the state that immediately after the paper sheet 10 has been transferred, covering the depressions 29. At this time, more air flows through the suction hole 36-3 than through the suction hole 36-2. The pressure in the small chamber 40 therefore falls relatively fast. Hence, the valve 33 is opened fast, and the paper sheet 10 is fast drawn onto the transfer belt 11.

If the suction hole 36-3, which has the largest opening area, is selected, the paper sheet 10 being transferred can be efficiently prevented from floating at its distal part. Therefore, the selection of the suction hole 36-3 is advisable in the case where the sheet transfer speed is high.

On the other hand, if the suction hole 36-1, which has the smallest opening area, is selected, air flows through this suction hole 36-1 in a relatively small amount. The airflow therefore less influences the ejection of ink droplets. In addition, the operating ability of the negative-pressure generating device, such as platen unit 15, can be lowered. Since it takes longer to draw the paper sheet 10, the selection of the suction hole 36-1 is desirable in the case where the sheet transfer speed is low.

Hence, it is desired that the suction hole 36-3 having the largest opening area be selected if the paper sheet 10 is transferred at high speed, and the suction hole 36-1 having the smallest opening area be selected if the paper sheet 10 is transferred at low speed.

The second embodiment may be modified as will be described below.

In the second embodiment described above, a plurality of suction holes 36-1 to 36-3 are made in the platen frame 14 for, each small chamber 40. One suction-hole selecting member 38 has selection holes 39. The second embodiment may be modified such that selection holes 39 are made in the platen frame 14 and a plurality of suction holes 36-1 to 36-3 are made in the suction-hole selecting member 38.

Figure 14:
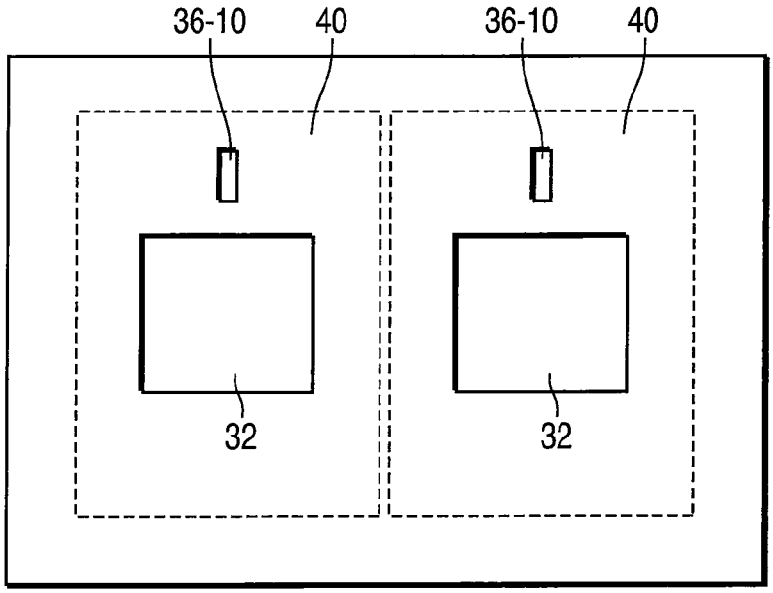
FIG. 14 is a diagram sowing the configuration of a modification of the second embodiment of the image recording apparatus according to this invention.
Figure 15:
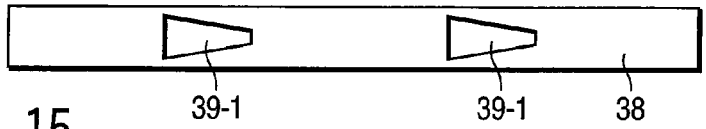
FIG. 15 is diagram showing the configuration of the suction-hole selecting member of the apparatus.
Figure 16:
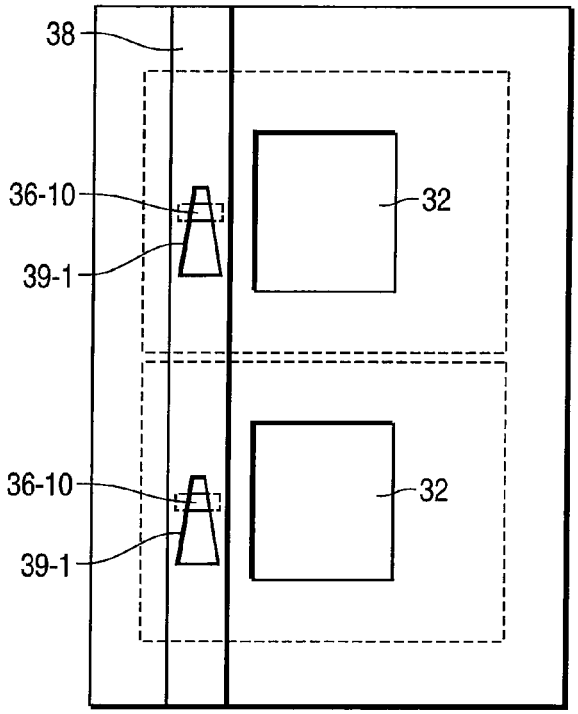
FIG. 16 is a diagram explaining how the open areas are varied in the apparatus.

Alternatively, the second embodiment described above may be modified as follows. FIG. 14 is a diagram showing two of the small chambers 40 as viewed from above. One rectangular hole 36-10 is made in the bottom of each small chamber 40. The rectangular hole 36-10 is elongated in, for example, the Y-axis direction. On the bottom of the small chamber 40, such a suction-hole selecting member 38 as shown in FIG. 15, used as a closing member, is provided and able to slide in the X-axis direction. The suction-hole selecting member 38 has opening adjusting holes 39-1. As seen from FIG. 16, the opening adjusting holes 39-1 can change the opening area of the rectangular holes 36-10 as the suction-hole selecting member 38 is slid in the X-axis direction.

A third embodiment of this invention will be described.

Figure 17:
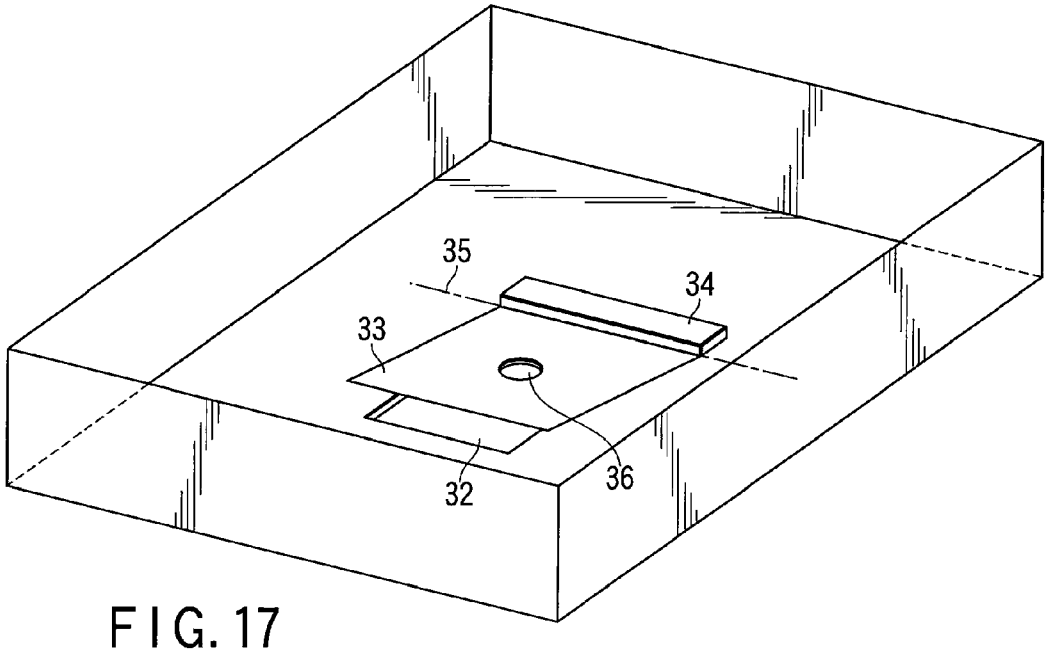
FIG. 17 is a perspective view of one of the small chambers provided in a third embodiment of an image recording apparatus according to the present invention.

FIG. 17 is a perspective view showing one of the small chambers that are provided in the third embodiment of an image recording apparatus according to this invention. A suction hole 36 is made in the center part of a valve 33. The suction hole 36 may be made in any other part of the valve 33, not necessarily in the center part. In this embodiment, only the suction hole 32 need be made in the bottom of each small chamber 40. The area the chamber 40 occupies can therefore be smaller than otherwise. This makes it possible to arrange as many suction holes as possible in the platen frame 14.

A fourth embodiment of this invention will be described.

Figure 18:
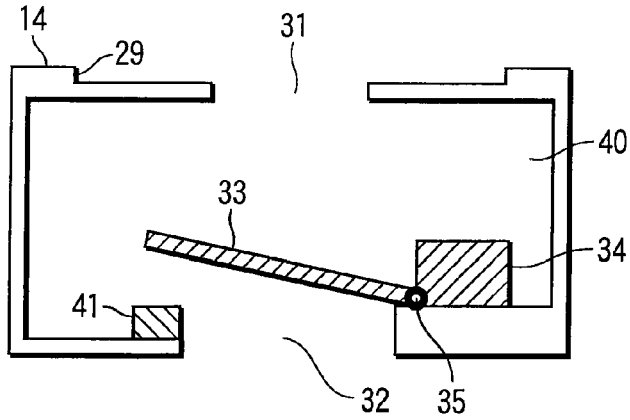
FIG. 18 is a diagram showing the configuration of a fourth embodiment of an image recording apparatus according to this invention.

FIG. 18 is a sectional view showing the configuration of one of the small chambers 40. On the rim of the suction hole 32, except that part of the rim, at which an axle 35 is positioned, a porous member 41 is provided. The porous member 41 can be made of, for example, foamed urethane. The porous member 41 performs the function of tiny suction holes. The use of the porous member 41 can reduce the sound generated when the valve 33 is closed. The sound the image recording apparatus makes as it operates can be thereby decreased.

A fifth embodiment of this invention will be described.

Figure 19:
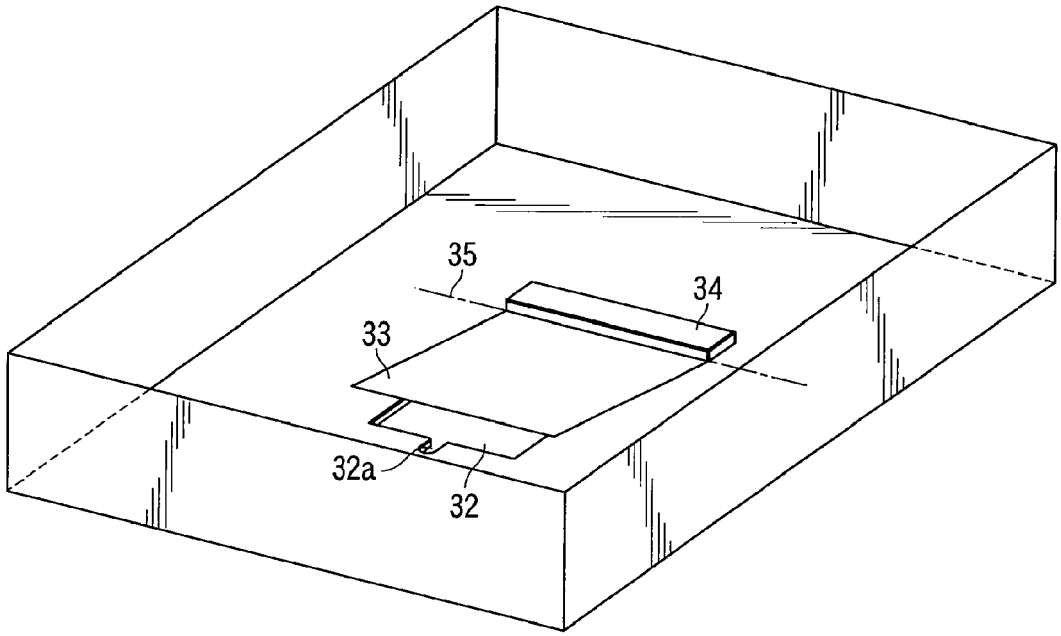
FIG. 19 is a perspective view of one of small chambers provided in a fifth embodiment of an image recording apparatus according to this invention.
Figure 20:
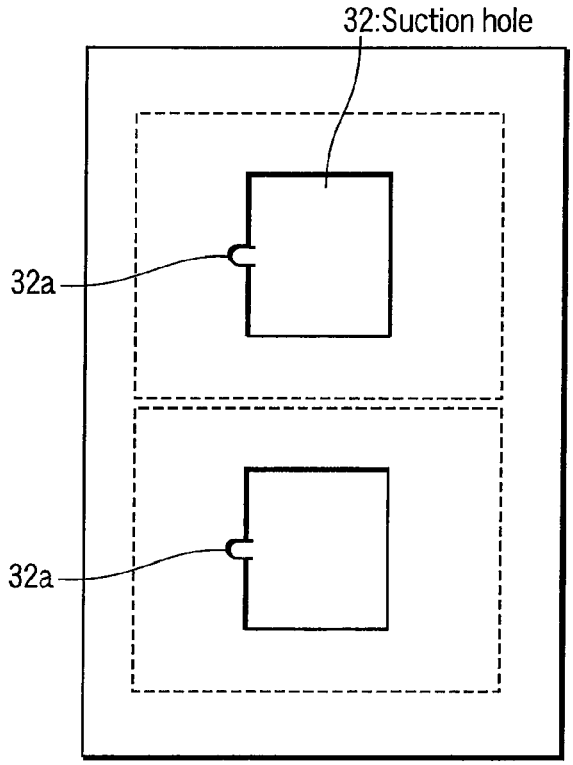
FIG. 20 is a diagram showing that the valves of the small chambers are opened in the apparatus.
Figure 21:
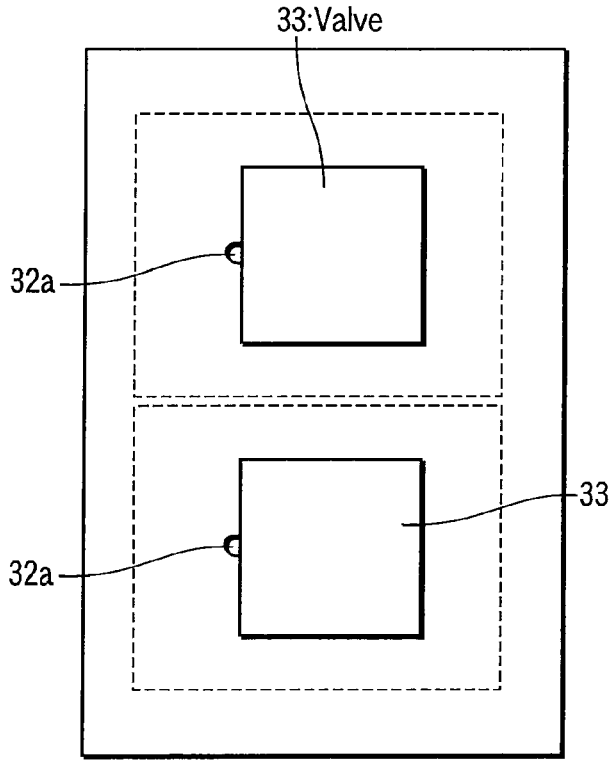
FIG. 21 is a diagram showing that the valves of the small chambers are closed in the apparatus.

FIG. 19 is a perspective view of one of small chambers 40 used in the fifth embodiment. FIG. 20 shows the state in which the valve of each small chamber 40 is open. The valve structure comprises a valve 33 and a suction hole 32. The suction hole 32 is made in the bottom of the small chamber 40. A projecting suction hole 32*a* is provided and is continuous to the suction hole 32. The projecting suction hole 32*a* remains open if the valve 33 closes the suction hole 32. That is, only the projecting suction hole 32*a* is open even if the suction hole 32 is closed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

Figure 22:
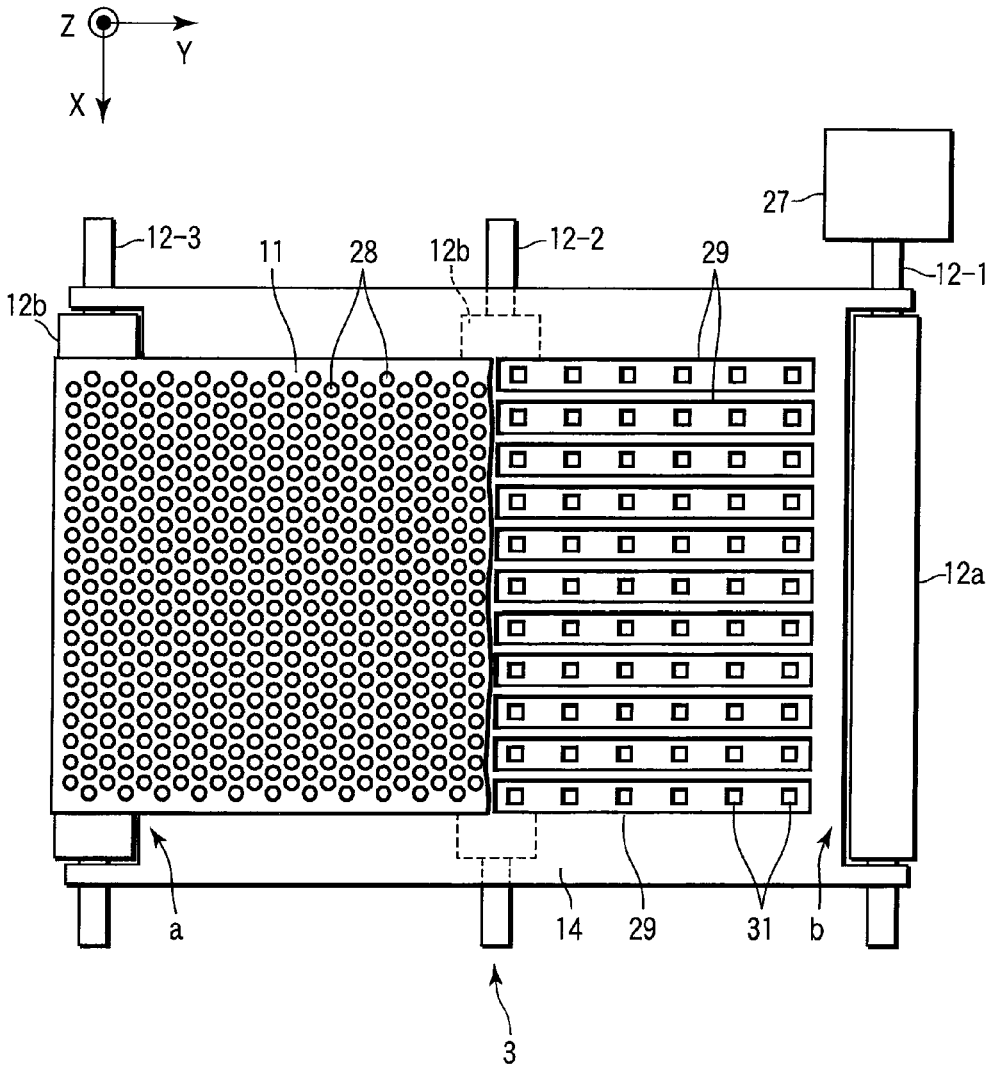
FIG. 22 is a diagram showing depressions of a modified shape, made in the upper surface of the platen frame provided in the apparatus.

In some cases it may not be advisable to make many depressions 29 in the upper surface of the platen frame 14, in view of manufacturing cost. If so, less depression 29 should better be made in the platen plate 14. FIG. 22 shows an exemplary configuration, wherein the number of depressions 29 is decreased. A plurality of depressions 29 are made in the upper surface of the platen frame 14, each being shaped like a band and extending in the sheet transfer direction (i.e., Y-axis direction). In each depression 29, one or more suction holes 31 are made.

The configuration described above is appropriate if the paper sheet 10 is long in its transfer direction and if its width varies, like a rolled paper sheet. Since one depression 29 need not be provided for each suction hole 31, the manufacturing cost can be lowered. The configuration shown in FIG. 22 has a plurality of suction holes 31. Nonetheless, only one suction hole 31 may be provided.

Figure 23:
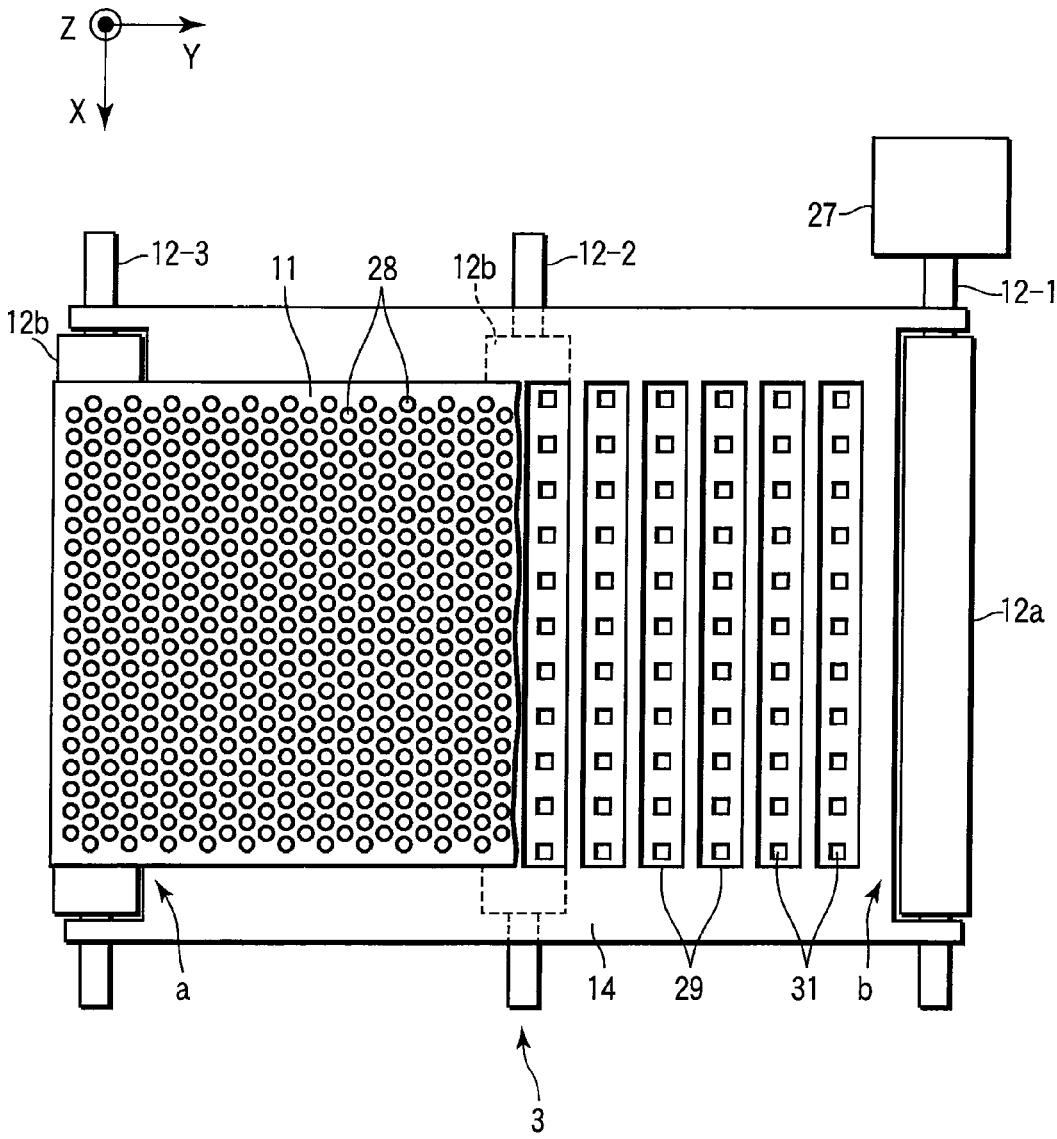
FIG. 23 is a diagram showing depressions of another modified shape, made in the upper surface of the platen frame provided in the apparatus.

FIG. 23 shows a configuration in which the number of depression is reduced. Depressions 29 made in the upper surface of the platen frame 14 are arranged in rows extending in a direction (X-axis direction) that is orthogonal to the sheet transfer direction. One or more suction holes 31 are made in each depression 29. This configuration is appropriate if the paper sheets 10 have a constant width that is almost equal to the width of the depressions 29. In this case, too, one depression 29 need not be made for each suction hole 31, to lower the manufacturing cost. In FIG. 23, a plurality of suction holes 31 are made. Nonetheless, only one suction hole 31 may be made.

What is claimed is:

1. An image recording apparatus comprising:

a transfer unit having a transfer surface for holding a recording medium and configured to transfer the recording medium held on the transfer surface;

a recording head opposed to the transfer unit and configured to record images on the recording medium transferred by the transfer unit;

at least one suction-force changing unit configured to draw the recording medium;

a support member provided at substantially the same height as the transfer surface of the transfer unit and supporting the suction-force changing unit; and a suction unit configured to draw the recording medium to a surface of the support member, via the suction-force changing unit, wherein:

the suction-force changing unit includes an air passage unit that includes an opening area, and enables air to be drawn from the recording medium side to the suction unit side, and a valve that opens or closes the opening area of the air passage unit in accordance with a pressure difference between the recording medium side and the suction unit side;

the valve closes the air passage unit, setting the opening area of the air passage unit to value B (0<B), when the pressure in the suction unit side is lower than the pressure at the recording medium side, and opens the air passage unit, setting the opening area of the air passage unit to value A (B<A), when the pressure at the recording medium side approaches the pressure in the suction unit side; and the suction-force changing unit draws air from the recording medium side to the suction unit side through the air passage unit having the opening area B, thereby opening the valve that closes the air passage unit because the pressure in the suction unit side is lower than the pressure at the recording medium side, thus lowering the pressure at the recording medium side toward the pressure in the suction unit side.

2. The image recording apparatus according to claim 1, wherein the air passage unit includes a first opening and a second opening that differ from each other in terms of opening area, the valve is configured to open and close the first opening, and the valve and the air passage unit are so shaped that the opening area of sum of the first and second openings is defined as A when the valve opens the first opening, and the opening area of sum of the first and second openings is defined as B when the valve closes the first opening.

3. The image recording apparatus according to claim 2, wherein the second opening has the opening area smaller than the opening area of the first opening.

4. The image recording apparatus according to claim 2, wherein the second opening of the air passage unit comprises a plurality of openings, and the second opening area that is a sum of the opening areas of the plurality of openings is smaller than the opening area of the first opening.

5. The image recording apparatus according to claim 4, wherein the plurality of openings have different opening areas.

6. The image recording apparatus according to claim 2, further comprising:

an opening-area changing mechanism configured to change the opening area of the second opening.

7. The image recording apparatus according to claim 6, wherein the opening-area changing mechanism includes a closing member configured to cover a part of the second opening, and a control unit configured to control the closing member, controlling the covering of the second opening.

8. The image recording apparatus according to claim 7, wherein the control unit controls the closing member in accordance with a speed at which the transfer unit transfers the recording medium, thereby changing the opening area of the second opening.

9. The image recording apparatus according to claim 7, wherein the control unit controls the closing member, increasing the opening area of the second opening when the transfer unit transfers the recording medium at high speed, and decreasing the opening area of the second opening when the transfer unit transfers the recording medium at low speed.

10. The image recording apparatus according to claim 2, wherein the second opening provides a gap when the valve closes the first opening in part, and a porous member is arranged in the gap.

11. The image recording apparatus according to claim 1, wherein:

the air passage unit includes an air passage member having the first opening, a second opening having an opening area smaller than the opening area of the first opening;

the valve is configured to open and close the first opening;

the second opening is provided at the valve.

12. The image recording apparatus according to claim 1, wherein the valve closes a part of the air passage unit, and the valve and the air passage unit are so shaped that the opening area of the air passage unit is defined as A when the valve opens the air passage unit, and the opening area of a gap between the valve and the air passage unit is defined as B when the valve closes the air passage unit.

13. The image recording apparatus according to claim 1, wherein the valve includes a flat-plate like member configured to open and close the air passage unit, a support member supporting the valve and allowing the valve to rotate between an opened position and a closed position, and a balancer formed integral with the valve and opposed to the valve across the support member, and the valve opens the opening by virtue of the weight of the balancer, while the suction-force changing unit is not worked.

14. The image recording apparatus according to claim 13, wherein the valve opens the air passage unit by virtue of the weight of the balancer when no pressure difference exists between the suction unit side and the recording medium side which are isolated by the flat-plate like member located at a specific position and closing the air passage unit.

15. An image recording apparatus comprising:

a transfer unit having a transfer surface for holding a recording medium and configured to transfer the recording medium held on the transfer surface;

a recording head opposed to the transfer unit and configured to record images on the recording medium transferred by the transfer unit;

at least one suction-force changing unit configured to draw the recording medium;

a support member provided at substantially the same height as the transfer surface of the transfer unit and supporting the suction-force changing unit; and a suction unit configured to draw the recording medium to a surface of the support member, via the suction-force changing unit, wherein:

the suction-force changing unit includes a plurality of air passage units which are provided between the recording medium side and the suction unit side and which serve to draw air toward the suction unit, and a valve that opens or closes only some of the air passage units;

the valve closes some of the air passage units when the pressure in the suction unit side becomes lower than the pressure at the recording medium; side and a pressure difference between the recording medium side and the suction unit side decreases as air is drawn from the recording medium side toward the suction unit side, and the valve opens some of the air passage units, when air is drawn from the recording medium side toward the suction unit side through the other air passage units not closed by the suction-force changing unit, immediately after the suction unit is covered with the recording medium transferred.

16. An image recording apparatus comprising:

a transfer unit having a transfer surface for holding a recording medium and configured to transfer the recording medium held on the transfer surface;

a recording head opposed to the transfer unit and configured to record images on the recording medium transferred by the transfer unit;

at least one suction-force changing unit configured to draw the recording medium;

a support member provided at substantially the same height as the transfer surface of the transfer unit and supporting the suction-force changing unit;

a suction unit configured to draw the recording medium to a surface of the support member, via the suction-force changing unit;

a first air passage unit provided in the suction-force changing unit and enabling air to flow between the recording medium side and the suction unit side;

a valve configured to open and close the first air passage unit by virtue of a pressure difference between the recording medium side and the suction unit side;

a second air passage unit provided in the suction-force changing unit and configured to draw air from the recording medium side toward the suction unit side and thereby decrease the pressure difference between the recording medium side and the suction unit side in order to open the first air passage unit, when the recording medium covers the suction unit in a state where the valve closes the first air passage unit.

* * * * *